US008833492B2

(12) United States Patent
Durairajan et al.

(10) Patent No.: US 8,833,492 B2
(45) Date of Patent: Sep. 16, 2014

(54) CUTTERS FOR FIXED CUTTER BITS

(75) Inventors: Bala Durairajan, Houston, TX (US); Carl M. Hoffmaster, Houston, TX (US)

(73) Assignee: Smith International, Inc., Houston, TX (US)

( * ) Notice: Subject to any disclaimer, the term of this patent is extended or adjusted under 35 U.S.C. 154(b) by 1165 days.

(21) Appl. No.: 12/247,959

(22) Filed: Oct. 8, 2008

(65) Prior Publication Data

US 2010/0084198 A1 Apr. 8, 2010

(51) Int. Cl.
*E21B 10/567* (2006.01)
*E21B 10/55* (2006.01)

(52) U.S. Cl.
CPC ..... *E21B 10/55* (2013.01); *E21B 10/5673* (2013.01)
USPC ..... 175/430; 175/426; 175/374

(58) Field of Classification Search
USPC ..... 175/426, 430, 374
See application file for complete search history.

(56) References Cited

U.S. PATENT DOCUMENTS

| | | | | |
|---|---|---|---|---|
| 3,745,623 | A | 7/1973 | Wentorf, Jr. et al. | |
| 4,108,260 | A | 8/1978 | Bozarth | |
| 4,254,840 | A * | 3/1981 | Shay, Jr. | 175/426 |
| 4,334,586 | A | 6/1982 | Schumacher | |
| 4,558,753 | A | 12/1985 | Barr | |
| 4,570,726 | A | 2/1986 | Hall | |
| 4,593,777 | A | 6/1986 | Barr et al. | |
| 4,776,413 | A * | 10/1988 | Forsberg | 175/426 |
| 4,858,707 | A | 8/1989 | Jones et al. | |
| 4,872,520 | A | 10/1989 | Nelson | |
| 4,984,642 | A | 1/1991 | Renard et al. | |
| 5,010,789 | A | 4/1991 | Brett et al. | |
| 5,025,874 | A | 6/1991 | Barr et al. | |
| 5,314,033 | A | 5/1994 | Tibbitts | |
| 5,332,051 | A | 7/1994 | Knowlton | |
| 5,377,773 | A | 1/1995 | Tibbitts | |
| 5,379,853 | A | 1/1995 | Lockwood et al. | |
| 5,415,244 | A | 5/1995 | Portwood | |
| 5,437,343 | A | 8/1995 | Cooley et al. | |
| 5,443,565 | A | 8/1995 | Strange, Jr. | |
| 5,460,233 | A | 10/1995 | Meany et al. | |
| 5,467,836 | A | 11/1995 | Grimes et al. | |
| 5,592,995 | A | 1/1997 | Scott et al. | |
| 5,647,449 | A * | 7/1997 | Dennis | 175/434 |
| 5,649,604 | A | 7/1997 | Fuller et al. | |

(Continued)

FOREIGN PATENT DOCUMENTS

| | | | |
|---|---|---|---|
| GB | 2307933 | A | 6/1997 |
| GB | 2403967 | A | 1/2005 |
| SU | 791889 | A1 | 12/1980 |
| WO | 2004072435 | A1 | 8/2004 |

OTHER PUBLICATIONS

Combined Search and Examination Report which cites SU791889 issued in Application No. GB0508876.0 dated Jun. 15, 2005 (8 pages).

*Primary Examiner* — Jennifer H Gay
(74) *Attorney, Agent, or Firm* — Osha Liang LLP

(57) ABSTRACT

A PDC cutter includes a body formed from a substrate material, an ultrahard layer disposed on the body, and a concave cutting face perpendicular to an axis of the body. A PDC cutter includes a body formed from a substrate material, an ultrahard layer disposed on the body, and a non-planar cutting face perpendicular to an axis of the body, the cutting face including a circumferential concave portion, and an inner protrusion portion.

19 Claims, 8 Drawing Sheets

(56) References Cited

U.S. PATENT DOCUMENTS

| | | | | |
|---|---|---|---|---|
| 5,706,906 | A | 1/1998 | Jurewicz et al. | |
| 5,813,485 | A | 9/1998 | Portwood | |
| 5,871,060 | A | 2/1999 | Jensen et al. | |
| 5,881,830 | A | 3/1999 | Cooley | |
| 5,992,549 | A | 11/1999 | Fuller et al. | |
| 6,003,623 | A * | 12/1999 | Miess | 175/430 |
| 6,045,440 | A | 4/2000 | Johnson et al. | |
| 6,053,263 | A | 4/2000 | Meiners | |
| 6,059,054 | A | 5/2000 | Portwood et al. | |
| 6,065,554 | A | 5/2000 | Taylor et al. | |
| 6,135,219 | A | 10/2000 | Scott | |
| 6,145,607 | A | 11/2000 | Griffin et al. | |
| 6,199,645 | B1 | 3/2001 | Anderson et al. | |
| 6,202,770 | B1 | 3/2001 | Jurewicz et al. | |
| 6,227,318 | B1 | 5/2001 | Siracki | |
| 6,332,503 | B1 | 12/2001 | Pessier et al. | |
| 6,412,580 | B1 * | 7/2002 | Chaves | 175/432 |
| 6,510,910 | B2 | 1/2003 | Eyre et al. | |
| 6,527,069 | B1 * | 3/2003 | Meiners et al. | 175/432 |
| 6,550,556 | B2 | 4/2003 | Middlemiss et al. | |
| 6,604,588 | B2 | 8/2003 | Eyre et al. | |
| 6,672,406 | B2 * | 1/2004 | Beuershausen | 175/57 |
| 6,749,033 | B2 * | 6/2004 | Griffin et al. | 175/428 |
| 6,772,848 | B2 * | 8/2004 | Chaves | 175/432 |
| 6,883,624 | B2 | 4/2005 | McDonough | |
| 6,904,983 | B2 | 6/2005 | Thigpen et al. | |
| 6,904,984 | B1 * | 6/2005 | Estes et al. | 175/430 |
| 6,929,079 | B2 | 8/2005 | McDonough et al. | |
| 7,013,999 | B2 | 3/2006 | Tufts | |
| 7,140,448 | B2 * | 11/2006 | Estes et al. | 175/430 |
| 7,363,992 | B2 * | 4/2008 | Stowe et al. | 175/426 |
| 7,493,972 | B1 * | 2/2009 | Schmidt et al. | 175/432 |
| 7,604,074 | B2 * | 10/2009 | Eyre et al. | 175/432 |
| 7,798,257 | B2 * | 9/2010 | Shen et al. | 175/430 |
| 2002/0112897 | A1 * | 8/2002 | Chaves | 175/432 |
| 2004/0163851 | A1 * | 8/2004 | McDonough et al. | 175/374 |
| 2004/0245025 | A1 * | 12/2004 | Eyre | 175/432 |
| 2005/0263327 | A1 | 12/2005 | Meiners et al. | |
| 2005/0269139 | A1 | 12/2005 | Shen et al. | |
| 2006/0011388 | A1 | 1/2006 | Boudrare et al. | |
| 2006/0283640 | A1 * | 12/2006 | Estes et al. | 175/434 |
| 2007/0235230 | A1 | 10/2007 | Cuillier et al. | |
| 2008/0006448 | A1 | 1/2008 | Zhang et al. | |
| 2008/0190666 | A1 * | 8/2008 | Gatell | 175/57 |
| 2008/0264696 | A1 * | 10/2008 | Dourfaye et al. | 175/428 |
| 2008/0302578 | A1 * | 12/2008 | Eyre et al. | 175/430 |
| 2010/0084198 | A1 * | 4/2010 | Durairajan et al. | 175/430 |

* cited by examiner

CUTTERS FOR FIXED CUTTER BITS

BACKGROUND OF MENTION

1. Field of the Invention

Embodiments disclosed herein generally relate to drill bits for drilling earth formations. In particulars, embodiments disclosed herein relate to cutters for a fixed cutter drill bit.

2. Background Art

Rotary drill bits with no moving elements on them are typically referred to as "drag" bits or fixed cutter drill bits. Drag bits are often used to drill a variety of rock formations. Drag bits include those having cutters (sometimes referred to as cutter elements, cutting elements, polycrystalline diamond compact ("PDC") cutters, or inserts) attached to the bit body. The cutters may be formed having a substrate or support stud made of carbide, for example tungsten carbide, and an ultrahard cutting surface layer or "table" made of a polycrystalline diamond or polycrystalline boron nitride material deposited onto or otherwise bonded to the substrate at an interface surface.

An example of a prior art drag bit having a plurality of cutters with ultrahard working surfaces is shown in FIG. 1. The drill bit 10 includes a bit body 12 and a plurality of blades 14 that are formed on the bit body 12. The blades 14 are separated by channels or gaps 16 that enable drilling fluid to flow between to clean and cool the blades 14 and cutters 18. Cutters 18 are held in the blades 14 at predetermined angular orientations and radial locations to present working surfaces 20 with a desired back rake angle against a formation to be drilled. The working surfaces 20 are generally perpendicular to the axis 19 and side surface 21 of the cylindrical cutter 18. Thus, the working surface 20 and the side surface 21 meet or intersect to form a circumferential cutting edge 22.

Nozzles 23 are typically formed in the drill bit body 12 and positioned in the gaps 16 so that fluid can be pumped to discharge drilling fluid in selected directions and at selected rates of flow between the blades 14 for lubricating and cooling the drill bit 10, the blades 14, and the cutters 18. The drilling fluid also cleans and removes cuttings as the drill bit 12 rotates and penetrates the geological formation. The gaps 16, which may be referred to as "fluid courses," are positioned to provide additional flow channels for drilling fluid and to provide a passage for cuttings to travel past the drill bit 10 toward the surface of a wellbore (not shown).

The drill bit 10 includes a shank 24 and a crown 26. Shank 24 is typically formed of steel or a matrix material and includes a threaded pin 28 for attachment to a drill string. Crown 26 has a cutting face 30 and outer side surface 32. The particular materials used to form drill bit bodies are selected to provide adequate toughness, while providing good resistance to abrasive and erosive wear. For example, in the case where an ultrahard cutter is to be used, the bit body 12 may be made from powdered tungsten carbide (WC) infiltrated with a binder alloy within a suitable mold form. In one manufacturing process the crown 26 includes a plurality of holes or pockets 34 that are sized and shaped to receive a corresponding plurality of cutters 18.

The combined plurality of surfaces 20 of the cutters 18 effectively forms the cutting face of the drill bit 10. Once the crown 26 is formed, the cutters 18 are positioned in the pockets 34 and affixed by any suitable method, such as brazing, adhesive, mechanical means such as interference fit, or the like. The design depicted provides the pockets 34 inclined with respect to the surface of the crown 26. The pockets 34 are inclined such that cutters 18 are oriented with the working face 20 at a desired rake angle in the direction of rotation of the bit 10, so as to enhance cutting. It will be understood that in an alternative construction (not shown), the cutters can each be substantially perpendicular to the surface of the crown, while an ultrahard surface is affixed to a substrate at an angle on a cutter body or a stud so that a desired rake angle is achieved at the working surface.

A typical cutter 18 is shown in FIG. 2. The typical cutter 18 has a cylindrical cemented carbide substrate body 38 having an end face or upper surface 54 referred to herein as the "interface surface" 54. An ultrahard material layer (cutting layer) 44, such as polycrystalline diamond or polycrystalline cubic boron nitride, forms the working surface 20 and the cutting edge 22. A bottom surface 52 of the ultrahard material layer 44 is bonded on to the upper surface 54 of the substrate 38. The bottom surface 52 and the upper surface 54 are herein collectively referred to as the interface 46. The top exposed surface or working surface 20 of the cutting layer 44 is opposite the bottom surface 52. The cutting layer 44 typically has a flat or planar working surface 20, but may also have a convex exposed surface, that meets the side surface 21 at a cutting edge 22.

Cutters may be made, for example, according to the teachings of U.S. Pat. No. 3,745,623, whereby a relatively small volume of ultrahard particles such as polycrystalline diamond or cubic boron nitride is sintered as a thin layer onto a cemented tungsten carbide substrate. Flat top surface cutters, as shown in FIG. 2, are generally the most common and convenient to manufacture with an ultrahard layer, according to known techniques. It has been found that cutter chipping, spalling, and delamination are common failure modes for ultrahard flat top surface cutters.

Generally speaking, the process for making a cutter 18 employs a body of tungsten carbide as the substrate 38. The carbide body is placed adjacent to a layer of ultrahard material particles such as polycrystalline diamond or cubic boron nitride particles and the combination is subjected to high temperature at a pressure where the ultrahard material particles are thermodynamically stable. This results in recrystallization and formation of a polycrystalline ultrahard material layer, such as a polycrystalline diamond or polycrystalline cubic boron nitride layer, directly onto the upper surface 54 of the cemented tungsten carbide substrate 38.

Different types of bits are generally selected based on the nature of the geological formation to be drilled. Drag bits are typically selected for relatively soft formations such as sands, clays and some soft rock formations that are not excessively hard or excessively abrasive. However, selecting the best bit is not always straightforward, because many formations have mixed characteristics (i.e., the geological formation may include both hard and soft zones), depending on the location and depth of the well bore. Changes in the geological formation can affect the desired type of bit, the desired rate of penetration (ROP) of a bit, the desired rotation speed, and the desired downward force or weight-on-bit ("WOB"). Where a drill bit is operated outside the desired ranges of operation, the bit can be damaged or the life of the bit can be severely reduced.

For example, a drill bit normally operated in one general type of formation may penetrate into a different formation too rapidly or too slowly subjecting it to too little load or too much load. In another example, a drill bit rotating and penetrating at a desired speed may encounter an unexpectedly hard formation, possibly subjecting the bit to a sudden impact force. A formation material that is softer than expected may result in a high rate of rotation, a high ROP, or both, thereby causing the cutters to shear too deeply or to gouge into the geological formation.

Such conditions may place greater loading, excessive shear forces, and added heat on the working surface of the cutters. Rotation speeds that are too high without sufficient WOB, for a particular drill bit design in a given formation, can also result in detrimental instability (bit whirling) and chattering because the drill bit cuts too deeply or intermittently bites into the geological formation. Cutter chipping, spalling, and delamination, in these and other situations, are common failure modes for ultrahard flat top surface cutters.

Dome top cutters, which have dome-shaped top surfaces, have provided certain benefits against gouging and the resultant excessive impact loading and instability. This approach for reducing adverse effects of flat surface cutters is described in U.S. Pat. No. 5,332,051. An example of such a dome cutter in operation is depicted in FIG. 3. The prior art cutter 60 has a dome-shaped top or working surface 62 that is formed with an ultrahard layer 64 bonded to a substrate 66. The substrate 66 is bonded to a metallic stud 68. The cutter 60 is held in a blade 70 of a drill bit 72 (shown in partial section) and engaged with a geological formation 74 (also shown in partial section) in a cutting operation. The dome-shaped working surface 62 effectively modifies the rake angle A produced by the orientation of the cutter 60.

Scoop top cutters, as shown in U.S. Pat. No. 6,550,556, have also provided some benefits against the adverse effects of impact loading. This type of prior art cutter is made with a small "scoop" or depression formed on a substrate and an ultrahard layer, wherein the depression extends radially outward to a substrate periphery. The ultrahard layer is bonded to a substrate at an interface. The depression is formed in the critical region, such that the scooped or depressed region is in contact with the formation.

Beveled or radiused cutters have provided increased durability for rock drilling. U.S. Pat. Nos. 6,003,623 and 5,706,906 disclose cutters with radiused or beveled side walls. This type of prior art cutter has a cylindrical mount section with a cutting section, or diamond cap, formed at one of its axial ends. The diamond cap includes a cylindrical wall section. An annular, arc surface (radiused surface) extends laterally and longitudinally between a planar end surface and the external surface of the cylindrical wall section. The radiused surface is in the form of a surface of revolution of an arc line segment that is concave relative to the axis of revolution.

While conventional PDC cutters have been designed to increase the durability for rock drilling, cutting efficiency usually decreases. The cutting efficiency decreases as a result of the cutter dulling, thereby increasing the weight-bearing area. As a result, more WOB must be applied. The additional WOB generates more friction and heat and may result in spalling or cracking of the cutter. Additionally, ROP of the cutter may be decreased. Further, sudden high advance rates are common as the cutters tend to slide over the formation without engaging the formation. Balling of the formation is also a common concern in drilling in soft information.

Accordingly, there exists a need for a cutting structure for a PDC drill bit that more efficiently removes formation.

SUMMARY OF INVENTION

In one aspect, the embodiments disclosed herein relate to a PDC cutter including a body formed from a substrate material, an ultrahard layer disposed on the body, and a concave cutting face perpendicular to an axis of the body.

In another aspect, a PDC cutter including a body formed from a substrate material, an ultrahard layer disposed on the body, and a non-planar cutting face perpendicular to an axis of the body, the cutting face including a circumferential concave portion, and a central domed portion.

In another aspect, a PDC cutter including a body formed from a substrate material, an ultrahard layer disposed on the body, and a non-planar cutting face perpendicular to an axis of the body, the cutting face including a circumferential concave portion, and an inner protrusion portion.

In yet another aspect, a drill bit including a bit body, at least one blade formed on the bit body, at least one PDC cutter disposed on the at least one blade, the at least one PDC cutter including a body formed from a substrate material, an ultrahard layer disposed on the body, and a concave cutting face perpendicular to an axis of the body.

Other aspects and advantages of the invention will be apparent from the following description and the appended claims.

DETAILED DESCRIPTION

In one aspect, embodiments disclosed herein relate to fixed cutter or PDC drill bits used to drill wellbores through earth formation. More specifically, embodiments disclosed herein relate to cutters for fixed cutter drill bits.

Figure 1:
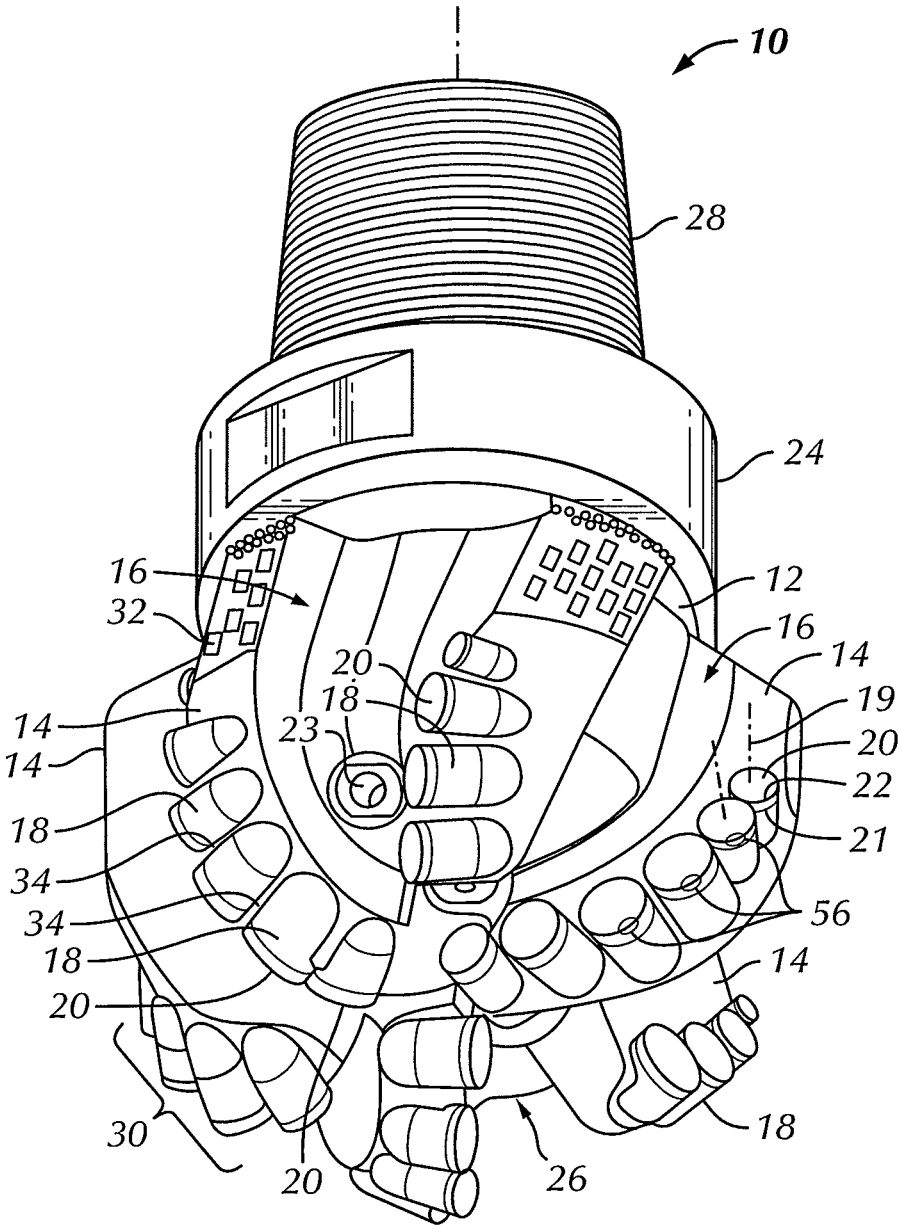
FIG. 1 (Prior Art)
FIG. 1 is a perspective view of a conventional fixed cutter drill bit.
Figure 2:
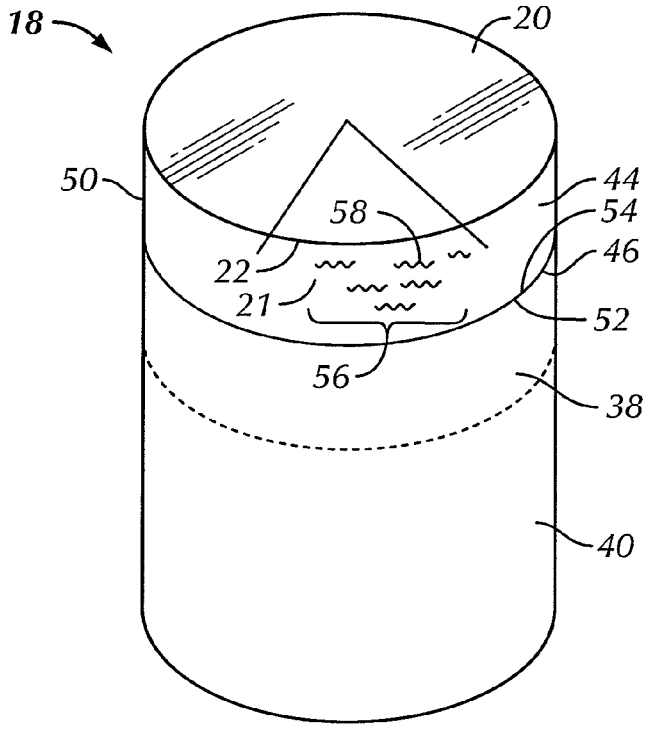
FIG. 2 (Prior Art)
FIG. 2 shows a conventional cutter for a fixed cutter drill bit.
Figure 3:
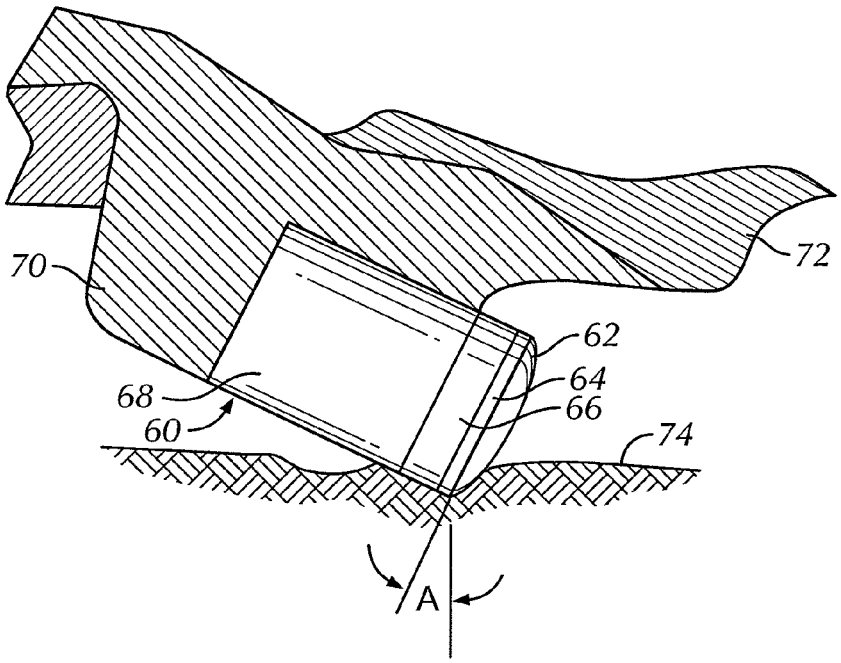
FIG. 3 (Prior Art)
FIG. 3 shows a conventional cutter of a fixed cutter drill bit engaging a formation.
Figure 4:
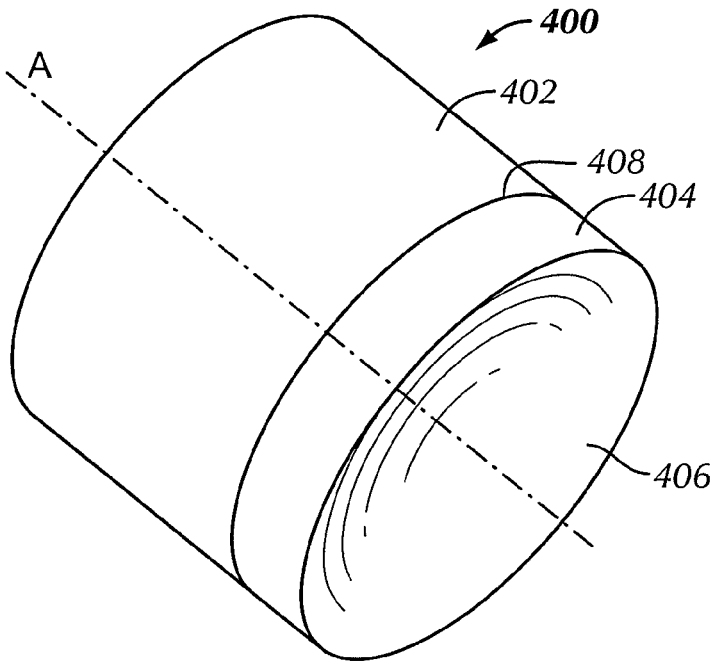
FIG. 4 shows a perspective view of a cutter formed in accordance with embodiments of the present disclosure.

Referring now to FIG. 4, a cutter 400 for a fixed cutter drill bit, e.g., a PDC cutter, formed in accordance with embodiments of the present disclosure is shown. Cutter 400 includes a body 402 and an ultrahard layer 404 disposed thereon. A cutting face 406 is formed perpendicular to a longitudinal axis A of the body 402 at a distal end of the ultrahard layer 404. Body 402 is generally cylindrical along longitudinal axis A and may be formed from any substrate material known in the art, for example, cemented tungsten carbide. Ultrahard layer 404 may be formed from any ultrahard material known in the art, for example, polycrystalline diamond or polycrystalline cubic boron nitride. A bottom surface (not shown) of the ultrahard material layer 404 is bonded to an upper surface (not shown) of the body 402. The surface junction between the bottom surface and the upper surface is herein collectively referred to as interface 408. The cutting face 406 is opposite the bottom surface of the ultrahard layer 404.

Figure 5:
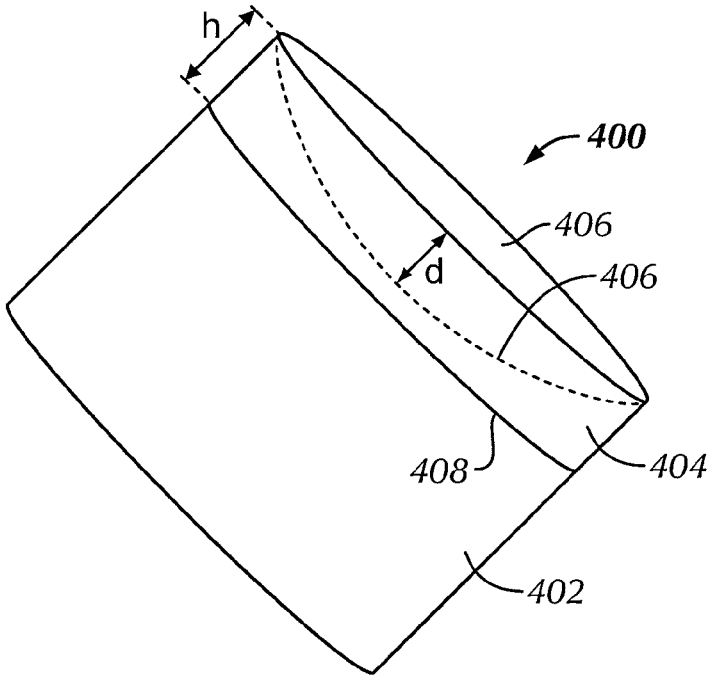
FIG. 5 shows a side view of a cutter formed in accordance with embodiments of the present disclosure.

As illustrated in FIGS. 4 and 5, the cutting face 406 is concave. As shown in more detail in FIG. 5, the curvature profile 409 is concave with respect to an upper plane of the cutter 400 perpendicular to the axis A. Thus, the cutting face 406 may be said to be dished or bowl-shaped. As shown in FIG. 5, the concave curvature profile 409 of the dished cutter 400 is formed in the ultrahard layer 404. A depth d of the curvature profile 409 may vary between a slightly dished cutting face to a depth d just less than a height h of the ultrahard layer 404. The height h of the ultrahard layer 406 is defined as the thickness of the ultrahard layer 404 at the thickest point, or as the length of the ultrahard layer 404 extending from the interface 408 between the ultrahard layer 404 and the body 402 to the upper plane of the cutter 400. The depth d may be measured at the 'deepest' point (i.e., the lowest point) on the curvature profile 409 of the dished cutter 400. The depth d of the curvature profile 409 may be selected by the designer based on, for example, the orientation of the cutter 400 with respect to the bit (not shown) or the back rake angle of the cutter, as discussed in more detail below. In certain embodiments, the depth d of the curvature profile 409 may be between 5 and 100 percent of the height h of the ultrahard layer 404. Thus, in certain embodiments, the substrate material or body 402 of cutter 400 may be exposed where the depth d of the curvature profile 409 is 100 percent of the height h of the ultrahard layer 404. In some embodiments, the depth d of the curvature profile 409 may be between 50 and 85 percent of the height h of the ultrahard layer 404. In a particular embodiment, the depth d of the curvature profile 409 may be approximately 85 percent of the height h of the ultrahard layer 404. While the curvature profile 409 shown in FIG. 5 is symmetrical, one of ordinary skill in the art will appreciate that the curvature profile 409 may be asymmetrical without departing from the scope of embodiments disclosed herein. Thus, in certain embodiments, the depth d of the cutter 400 may be centrally located within the cutting face 406, while in other embodiments the depth d of the cutter 400 may be offset from a central point of the cutting face 406.

Figure 6:
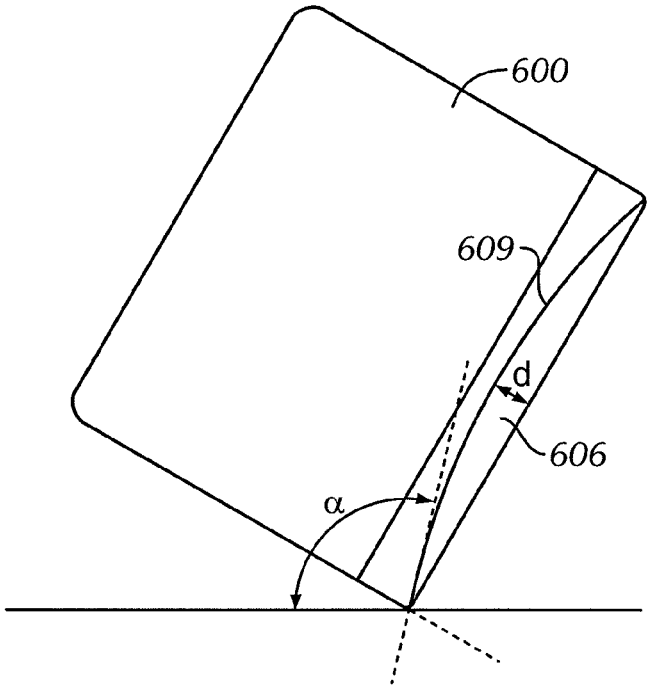
FIG. 6 shows a cross-sectional view of a cutter formed in accordance with embodiments of the present disclosure.
Figure 7:
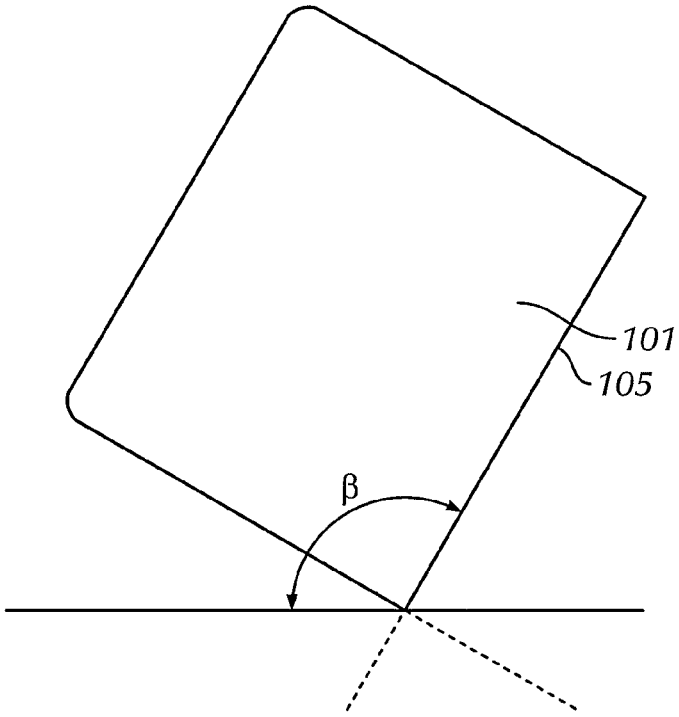
FIG. 7 (Prior Art)
FIG. 7 shows a cross-sectional view of a conventional cutter.
Figure 8:
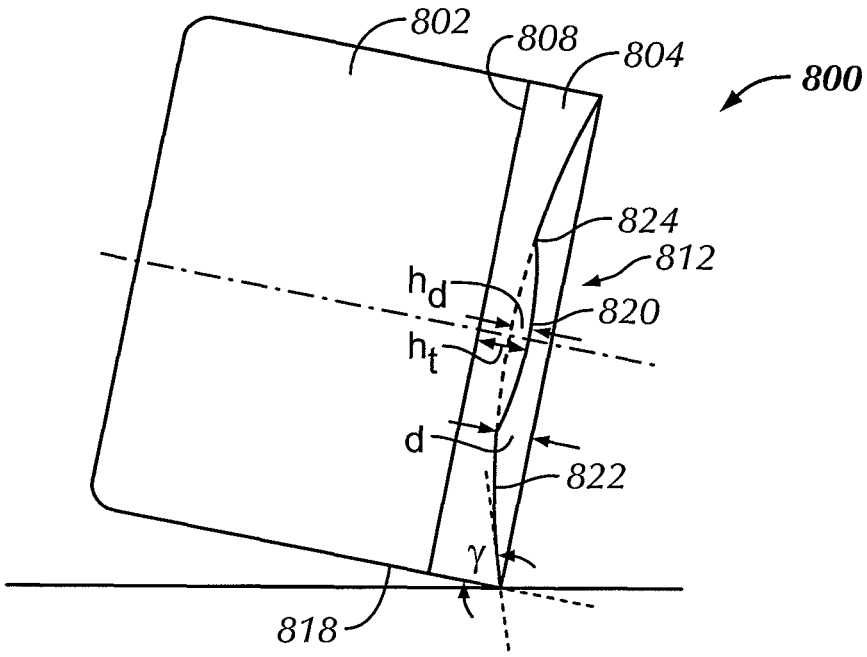
FIG. 8 shows a cross-sectional view of a cutter formed in accordance with embodiments of the present disclosure.

Referring now to FIGS. 6 and 7, cross-sectional views of a dished cutter 600, formed in accordance with embodiments disclosed herein, and a conventional cutter 101 are shown, respectively. Dished cutter 600 includes a concave cutting face 606 while conventional cutter 101 has a planar cutting face 105. For the same orientation, the dished cutter 600 may provide a smaller back rake angle $\alpha$ than the conventional cutter 101, shown by angle $\beta$. As used herein, the back rake angle is the angle between the cutting face and a line parallel to the formation being cut, or working surface. The aggressiveness of individual cutters may be controlled by adjusting the back rake angle of a cutter. Smaller back rake angles increase the ROP when drilling softer formation and may increase depth of cut. Thus, cutters 600 formed in accordance with embodiments disclosed herein may provide increased ROP and/or increased depth of cut as compared to conventional cutters 101.

As discussed above, the curvature profile 609 of the dished cutter 600, and in particular, the depth d of the curvature profile 609, may be selected based on the desired back rake angle $\alpha$ or ROP. Thus, a designer may select a curvature profile 609 that provides a desired back rake angle $\alpha$ when the cutter 600 is inserted in the cutter pocket (not shown) of the bit at a given orientation. Thus, when a higher ROP is desired on a bit run with conventional cutters, e.g., cutters 101, the conventional cutters may be replaced with cutters 600 formed in accordance with embodiments of the present disclosure at the same orientation as the conventional cutters to provide an increase in ROP.

Referring now to FIGS. 8-11, cutters 800, 900 formed in accordance with embodiments of the present disclosure are shown, wherein like parts are represented by like reference numbers. As shown with reference to FIG. 8, cutter 800 includes a cylindrical body 802 formed from a substrate material and an ultrahard layer 804 disposed thereon. A non-planar cutting face 812 is formed perpendicular to a longitudinal axis A of the body 802 at a distal end of the ultrahard layer 804. Body 802 is generally cylindrical along longitudinal axis A. A bottom surface (not shown) of the ultrahard material layer 804 is bonded on to an upper surface (not shown) of the body 802. The surface junction between the bottom surface and the upper surface is herein collectively referred to as interface 808. The cutting face 812 is opposite the bottom surface of the ultrahard layer 804.

Non-planar cutting face 812 includes a circumferential concave portion 822 and a central domed portion 820. As shown, the circumferential concave portion 822 slopes downward from the outer circumference of the ultrahard layer 804 towards the center of the interface 808. In one embodiment, circumferential concave portion 822 may include a concave profile, such that the surface of the circumferential concave portion 822 is dished. In other embodiments, circumferential concave portion 822 may include a linear profile, such that the surface of the circumferential concave portion 822 is substantially straight. In still other embodiments, the circumferential concave portion 822 may include a convex profile, such that the surface of the circumferential concave portion 822 is rounded.

The central domed portion 820 has a convex profile that protrudes or extends from the circumferential concave portion 822. Thus, a juncture 824 is formed between the downward sloping concave portion 822 and the central domed portion 820. The depth c of the circumferential concave portion 822 may be defined at the juncture 824. The depth d of the circumferential concave portion 822 may vary between 5 and 100 percent of the height h of the ultrahard layer 804. In certain embodiments, the depth d of the circumferential concave portion 822 may vary between 20 and 80 percent of the height h of the ultrahard layer 804.

Figure 10:
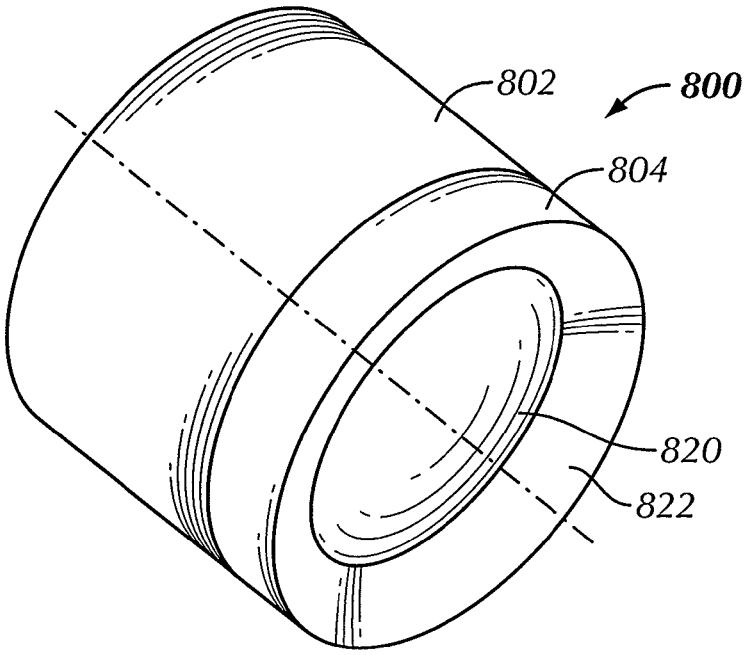
FIG. 10 shows a perspective view of the cutter of FIG. 8, formed in accordance with embodiments of the present disclosure.

The central domed portion 820 extends from the circumferential concave portion 822 a height $h_d$, as measured from the depth d of the circumferential concave portion 820. In the embodiment shown in FIG. 8, the dome height $h_d$ of the central domed portion 820 is less than the depth d of the circumferential concave portion 822. Thus, the total height $h_t$ of the central domed portion 820, that is the length from the interface 808 of the ultrahard layer 804 to the apex of the central domed portion 820, is less than the height h of the ultrahard layer 804. A perspective view of cutter 800 is shown in FIG. 10. As shown, the central domed portion 820 may be centered about longitudinal axis A; however, in some embodiments, central domed portion 820 may be offset from longitudinal axis A.

The radius of curvature of the circumferential concave portion 822 and the radius of curvature of the central domed portion 820 may vary. Likewise, the width, or radial length, of the circumferential concave portion 822 and the diameter of the central domed portion 820 may also vary. For example, the diameter of the central domed portion 820 may be in the range of 20 percent to 80 percent of the diameter of cutter 800. In particular embodiments, the diameter of central domed portion 820 may be 50 percent of the diameter of the cutter 800. Generally, the radius of curvature of the central domed portion 820 is much larger than the radius of curvature of the cutter, such that the surface of the central domed portion 820 is smooth. In some embodiments, the radius of curvature of the central domed portion 820 may be eight to twelve times larger than the radius of curvature of the cutter 800. In certain embodiments, the radius of curvature of the central domed portion 820 is ten times larger than the radius of curvature of the cutter 800.

Figure 9:
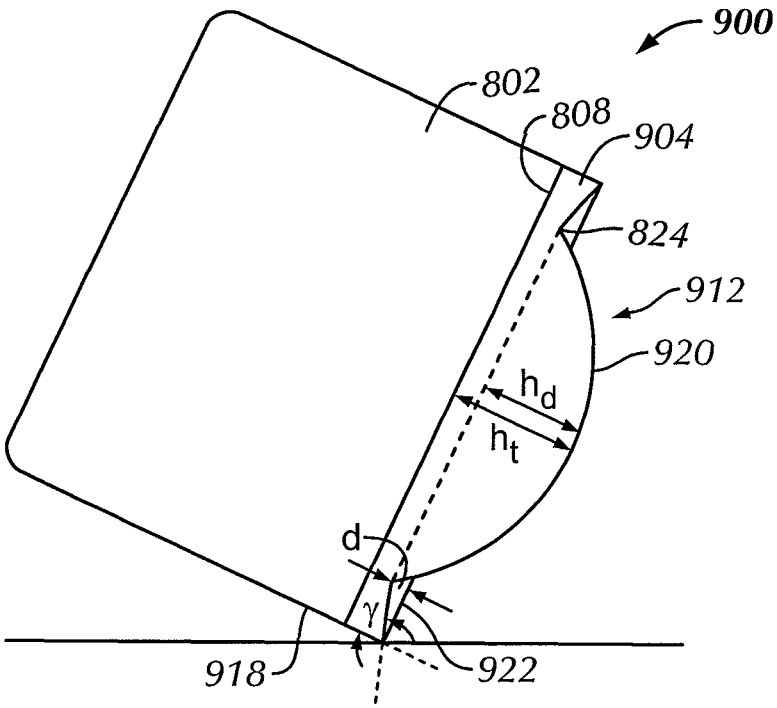
FIG. 9 shows a cross-sectional view of a cutter formed in accordance with embodiments of the present disclosure.

Referring now to FIG. 9, a cutter 900 formed in accordance with embodiments of the present disclosure is shown, wherein the dome height $h_d$ of the central domed portion 920 is greater than the depth d of the circumferential concave portion 922. Thus, the total height $h_t$ of the central domed portion 920 is greater than the height h of the ultrahard layer 904. A perspective view of cutter 900 is shown in FIG. 11.

Figure 11:
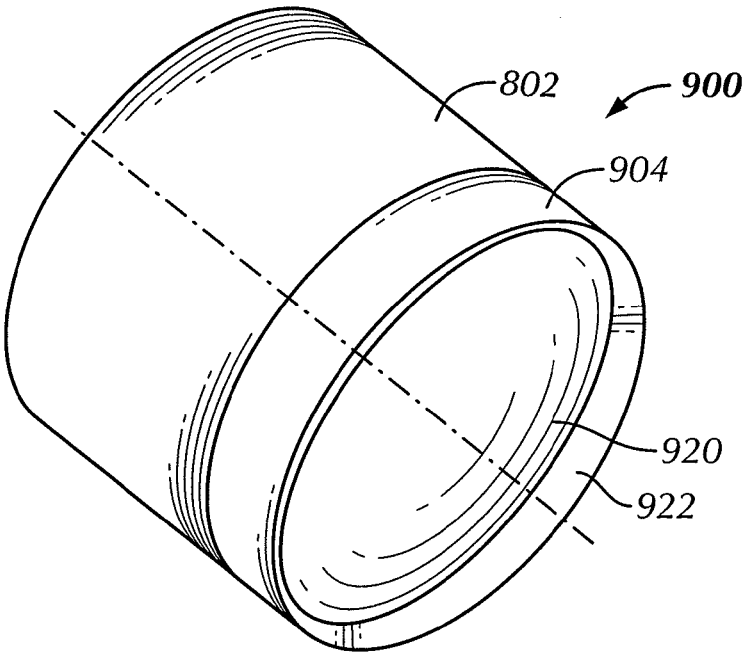
FIG. 11 shows a perspective view of the cutter of FIG. 9, formed in accordance with embodiments of the present disclosure.

Still referring to FIGS. 8-11, the radial width of the circumferential concave portion 822, 922 may be varied from a larger radial width (822, FIGS. 8, 10) to a smaller radial width (922, FIGS. 9, 11). The radius of curvature of the circumferential concave portion 822, 922 may also be varied, as shown by angle γ between the circumferential concave portion 822, 922 and the cutter side 818, 918. For example, angle γ may range between 45 degrees and 85 degrees. Further, the diameter or radius of curvature of central domed portion 820, 920 may also be varied. Additionally, the dome height $h_d$ or the total height $h_t$ of the central domed portion may also be varied. By varying the dimensions and angles of the circumferential concave portion 822, 922 and the central domed portion 820, 920 of the cutting face 812, 912 of the cutter 800, 900, the designer may select a cutter that provides, for example, a desired ROP or depth of cut.

Figure 12:
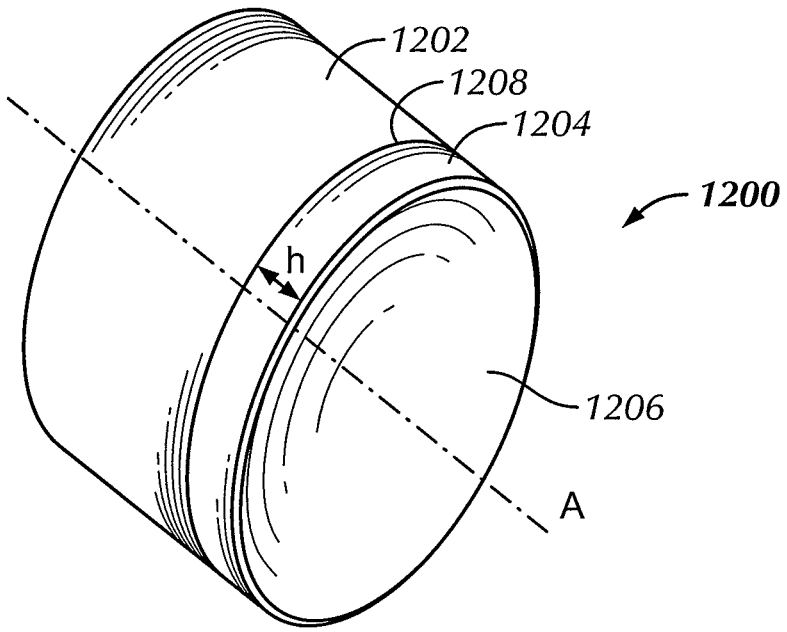
FIG. 12 shows a perspective view of a cutter formed in accordance with embodiments of the present disclosure.

Referring now to FIG. 12, an oval cutter 1200 for a fixed cutter drill bit formed in accordance with embodiments of the present disclosure is shown. Cutter 1200 includes a body 1202 and an ultrahard layer 1204 disposed thereon. A cutting face 1206 is formed perpendicular to a longitudinal axis A of the body 1202 at a distal end of the ultrahard layer 1204. In this embodiment, the cross-section of the body 1202 is generally oval along longitudinal axis A and may be formed from any substrate material known in the art, for example, cemented tungsten carbide. Ultrahard layer 1204 may be formed from any ultrahard material known in the art, for example, polycrystalline diamond or polycrystalline cubic boron nitride. A bottom surface (not shown) of the ultrahard material layer 1204 is bonded to an upper surface (not shown) of the body 1202. The surface junction between the bottom surface and the upper surface is herein collectively referred to as interface 1208. The cutting face 1206 is opposite the bottom surface of the ultrahard layer 1204.

As illustrated, the cutting face 1206 is concave. Thus, the cutting face 1206 may be said to be dished or bowl-shaped. Similar to the cutter 400 shown in FIGS. 4 and 5, a depth (d in FIG. 5) of the curvature profile (409 in FIG. 5) of cutter 1200 may vary between a slightly dished cutting face to a depth d just less than a height h of the ultrahard layer 1204. In certain embodiments, the depth d of the curvature profile may be between 5 and 100 percent of the height h of the ultrahard layer 1204. Thus, in certain embodiments, the substrate material or body 1202 of cutter 1200 may be exposed where the depth d of the curvature profile is 100 percent of the height h of the ultrahard layer 1204. In some embodiments, the depth d of the curvature profile may be between 50 and 85 percent of the height h of the ultrahard layer 1204. In a particular embodiment, the depth d of the curvature profile may be approximately 85 percent of the height h of the ultrahard layer 1204. While the curvature profile (409 in FIG. 5) is symmetrical, one of ordinary skill in the art will appreciate that the curvature profile may be asymmetrical without departing from the scope of embodiments disclosed herein. Thus, in certain embodiments, the maximum depth d of the curvature profile of the cutter 1200 may be centrally located within the cutting face 1206, while in other embodiments the maximum depth d of the curvature profile of the cutter 1200 may be offset from a central point of the cutting face 1206

Figure 13:
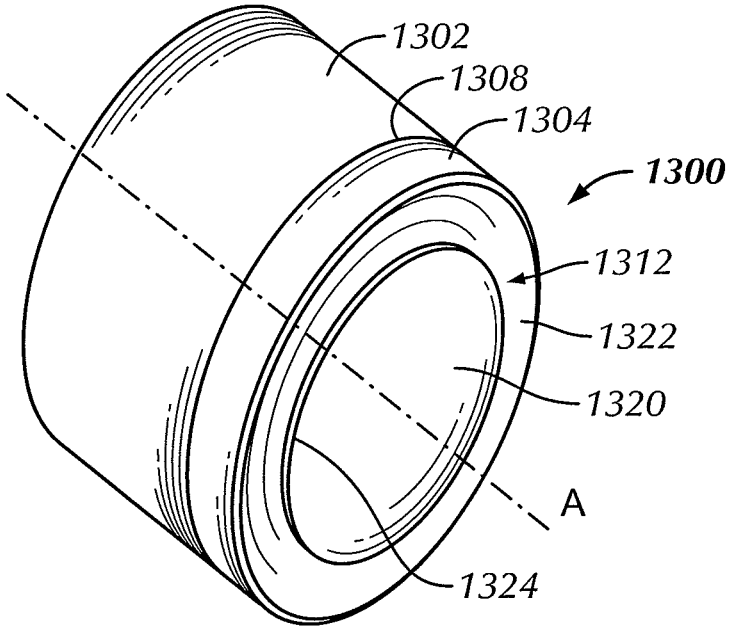
FIG. 13 shows a perspective view of a cutter formed in accordance with embodiments of the present disclosure.
Figure 14:
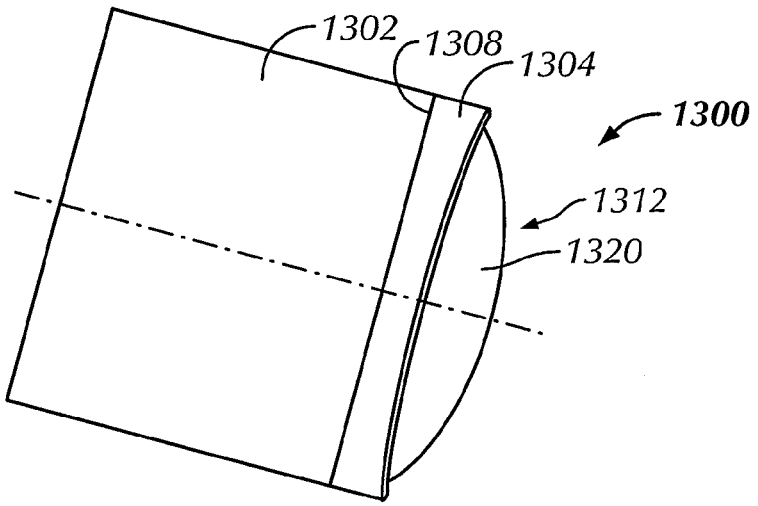
FIG. 14 shows a side view of the cutter of FIG. 13, formed in accordance with embodiments of the present disclosure.

Referring now to FIGS. 13 and 14, an oval cutter 1300 formed in accordance with embodiments disclosed herein is shown. Oval cutter 1300 includes a body 1302 formed from a substrate material and an ultrahard layer 1304 disposed thereon. A non-planar cutting face 1312 is formed perpendicular to a longitudinal axis A of the body 1302 at a distal end of the ultrahard layer 1304. Body 1302 has a generally oval cross-section along longitudinal axis A. A bottom surface (not shown) of the ultrahard material layer 1304 is bonded on to an upper surface (not shown) of the body 1302. The surface junction between the bottom surface and the upper surface is herein collectively referred to as interface 1308. The cutting face 1312 is opposite the bottom surface of the ultrahard layer 1304.

Non-planar cutting face 1312 includes a circumferential concave portion 1322 and a central domed portion 1320. As shown, the circumferential concave portion 1322 slopes downward from the outer circumference of the ultrahard layer 1304 towards the center of the interface 1308. In one embodiment, circumferential concave portion 1322 may include a concave profile, such that the surface of the circumferential concave portion 1322 is dished. In other embodiments, circumferential concave portion 1322 may include a linear profile, such that the surface of the circumferential concave portion 1322 is substantially straight. In still other embodiments, the circumferential concave portion 1322 may include a convex profile, such that the surface of the circumferential concave portion 1322 is rounded.

The central domed portion 1320 has a convex profile that protrudes or extends from the circumferential concave portion 1322. Thus, a juncture 1324 is formed between the downward sloping concave portion 1322 and the central domed portion 1320. As shown, the central domed portion 1320 may have an oval cross-section. In other embodiments, the cross-section of the central domed portion 1320 of the oval cutter 1300 may be circular. The depth d of the circumferential concave portion 1322 may be defined at the juncture 1324. The depth d of the circumferential concave portion 1322 may vary between 5 and 100 percent of the height h of the ultrahard layer 1304. In certain embodiments, the depth d of the circumferential concave portion 1322 may vary between 20 and 80 percent of the height h of the ultrahard layer 1304.

The central domed portion 1320 extends from the circumferential concave portion 1322 a selected dome height (see $h_d$ in FIGS. 8 and 9), as measured from the depth d of the circumferential concave portion 1322. In one embodiment, the selected dome height of the central domed portion 1320 is less than the depth d of the circumferential concave portion 1322. Thus, the total height ($h_t$ in FIG. 8) of the central domed portion 1320, that is the length from the interface 1308 of the ultrahard layer 1304 to the apex of the central domed portion 1320, may be less than the height h of the ultrahard layer 1304. In other embodiments, the dome height $h_d$ of the central domed portion 1320 is greater than the depth d of the circumferential concave portion 1322. Thus, the total height $h_t$ of the central domed portion 1320 is greater than the height h of the ultrahard layer 1304. As shown, the central domed portion 1320 may be centered about longitudinal axis A; however, in some embodiments, central domed portion 1320 may be offset from longitudinal axis A.

As discussed above, in certain embodiments, a cutter formed in accordance with embodiments of the present disclosure may include an inner protrusion portion (e.g., central domed portions 820, 920, 1320) surrounded by a circumferential concave portion (e.g. 822, 922, 1322). In alternate embodiments, the cross-section of the inner protrusion portion may be square, rectangular, triangular, oval, or any other shape known in the art. Thus, in accordance with embodiments disclosed herein, a cylindrical cutter may include a circumferential concave portion and an inner protrusion portion that may be circular, oblong, square, etc. Similarly, an oval cutter in accordance with embodiments disclosed herein may include a circumferential concave portion and an inner protrusion portion that may be circular, oblong, square, etc.

Figure 15:
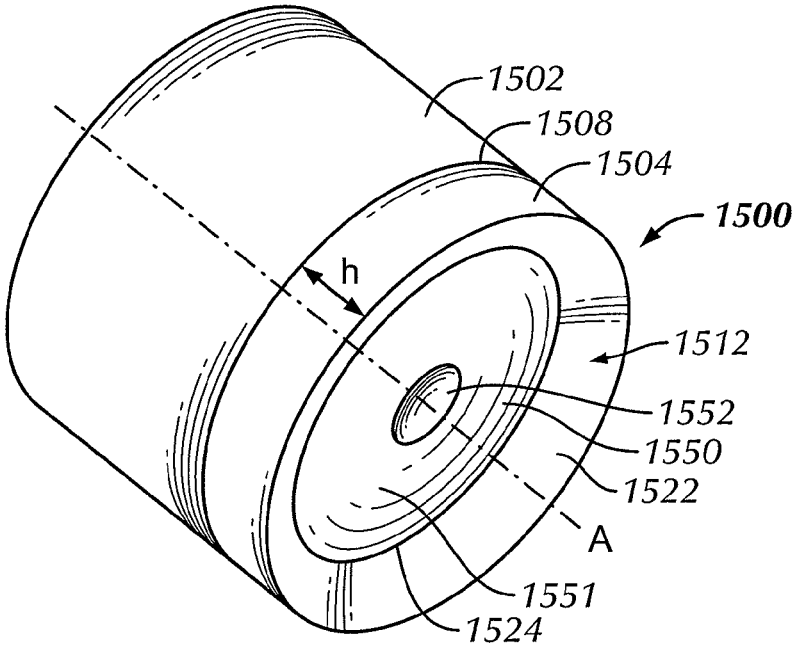
FIG. 15 shows a perspective view of a cutter formed in accordance with embodiments of the present disclosure.

Further, in certain embodiments, the inner protrusion portion may be toroidal in shape, as shown in FIG. 15. In this embodiment, a cutter 1500 includes a body 1502 and an ultrahard layer 1504 disposed thereon. A non-planar cutting face 1512 is formed perpendicular to a longitudinal axis A of the body 1502 at a distal end of the ultrahard layer 1504. The cross-section of the body 1502 may by circular or oval along longitudinal axis A and may be formed from any substrate material known in the art, for example, cemented tungsten carbide. Ultrahard layer 1504 may be formed from any ultrahard material known in the art, for example, polycrystalline diamond or polycrystalline cubic boron nitride. A bottom surface (not shown) of the ultrahard material layer 1504 is bonded to an upper surface (not shown) of the body 1502. The surface junction between the bottom surface and the upper surface is herein collectively referred to as interface 1508. The cutting face 1512 is opposite the bottom surface of the ultrahard layer 1504.

Non-planar cutting face 1512 includes a circumferential concave portion 1522 and an inner protrusion portion 1550. As shown, the circumferential concave portion 1522 slopes downward from the outer circumference of the ultrahard layer 1504 towards the center of the interface 1508. In one embodiment, circumferential concave portion 1522 may include a concave profile, such that the surface of the circumferential concave portion 1522 is dished. In other embodiments, circumferential concave portion 1522 may include a linear profile, such that the surface of the circumferential concave portion 1522 is substantially straight. In still other embodiments, the circumferential concave portion 1522 may include a convex profile, such that the surface of the circumferential concave portion 1522 is rounded.

The inner protrusion portion 1550 has a convex profile that protrudes or extends from the circumferential concave portion 1522. Thus, a juncture 1524 is formed between the downward sloping concave portion 1522 and the inner protrusion portion 1550. As shown, the inner protrusion portion 1550 may have toroidal shape. In other words, the inner protrusion portion 1550 transitions from a convex profile 1551 to a concave profile 1552 towards the center of inner protrusion portion 1550. Thus, the cross-section of the inner protrusion portion 1550 may be similar to a washer or donut type shape. One of ordinary skill in the art will appreciate that the cross-section of the inner protrusion portion 1550 may be circular or oblong.

As discussed above with reference to other embodiments, the depth d of the circumferential concave portion 1522 may vary between 5 and 100 percent of the height h of the ultrahard layer 1504. In certain embodiments, the depth d of the circumferential concave portion 1522 may vary between 20 and 80 percent of the height h of the ultrahard layer 1504. Further, the inner protrusion portion 1550 extends from the circumferential concave portion 1522 a selected height, as measured from the depth d of the circumferential concave portion 1522. In one embodiment, the selected height of the inner protrusion portion 1550 is less than the depth d of the circumferential concave portion 1552. Thus, the total height ($h_t$ in FIG. 8) of the inner protrusion portion 1550, that is the length from the interface 1508 of the ultrahard layer 1504 to the highest point of the inner protrusion portion 1500, may be less than the height h of the ultrahard layer 1504. In other embodiments, the selected height of the inner protrusion portion 1550 is greater than the depth d of the circumferential concave portion 1522. Thus, the total height $h_t$ of the inner protrusion portion 1550 is greater than the height h of the ultrahard layer 1504.

The depth of the central concave profile 1552, similar to a notch or hole formed in the inner protrusion portion 1550, may vary. In one embodiment, the concave profile 1552 may extend inward, toward the body 1502 of the cutter 1500, between 5 and 100 percent of the total height ($h_t$ in FIGS. 8 and 9) of the inner protrusion portion 1550. Thus, in one embodiment, the concave profile 1552 may be a small notch in the surface of the inner protrusion portion 1550. In other embodiments, the concave profile 1552 may extend to the interface 1508 between the body 1502 and the ultrahard layer 1504. As shown, the inner protrusion portion 1550 may be centered about longitudinal axis A; however, in some embodiments, inner protrusion portion 1550 may be offset from longitudinal axis A. Similarly, the central concave profile 1522 of the toroidal-shaped inner protrusion portion 1550 may be centered or offset from longitudinal axis A and may be centered or offset from a centerline (not shown) of the inner protrusion portion 1550.

Advantageously, embodiments disclosed herein provide for a fixed cutter that may be placed in the same orientation on a bit as a conventional cutter, but provide a smaller back rake angle, thereby allowing for an increase in ROP. Additionally, cutters formed in accordance with embodiments of the present disclosure may provide for an increased depth of cut.

Embodiments disclosed herein provide a dished PDC cutter with an inner protrusion portion that may reduce balling of a formation. In particular, dished cutter with an inner protrusion portion, as described herein, may provide small cuttings instead of long ribbons of cuttings, thereby reducing the time and cost of cutting cleanup. Additionally, a cutter formed in accordance with embodiments disclosed herein may provide a self-sharpening effect to the cutting face of the cutter. Further, cutters formed in accordance with embodiments disclosed herein may provide chip control of the formation being cut. Sudden high advance rates or sliding of the cutter or bit may also be limited by cutters formed in accordance with embodiments of the present disclosure.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed:

1. A PDC cutter comprising:

a body formed from a substrate material;

an ultrahard layer disposed on the body; and a non-planar cutting face perpendicular to an axis of the body, the cutting face comprising:

a circumferential concave portion; and a central domed portion, wherein the circumferential concave portion slopes downward and radially inward from an outer circumference of the ultrahard layer.

2. The PDC cutter of claim 1, wherein a depth of the circumferential concave portion is less than a height of the ultrahard layer.

3. The PDC cutter of claim 1, wherein the circumferential concave portion includes a concave profile.

4. The PDC cutter of claim 1, wherein the circumferential concave portion includes a linear profile.

5. The PDC cutter of claim 1, wherein the circumferential concave portion includes a convex profile.

6. The PDC cutter of claim 1, wherein a height of the central domed portion is less than a depth of the circumferential concave portion.

7. The PDC cutter of claim 1, wherein a height of the central domed portion is greater than a depth of the circumferential concave portion.

8. The PDC cutter of claim 1, wherein a diameter of the central domed portion is between 20 and 80 percent of a diameter of the PDC cutter.

9. The PDC cutter of claim 1, wherein an angle between the circumferential concave portion and a cutter side is between 45 degrees and 85 degrees.

10. The PDC cutter of claim 1, wherein the central domed portion is centered about the axis of the body.

11. The PDC cutter of claim 1, wherein the central domed portion is offset from the axis of the body.

12. A PDC cutter comprising:

a body formed from a substrate material;

an ultrahard layer disposed on the body; and a non-planar cutting face perpendicular to an axis of the body, the cutting face comprising:

a circumferential concave portion; and an inner protrusion portion, wherein the circumferential concave portion slopes downward and radially inward from an outer circumference of the ultrahard layer.

13. The PDC cutter of claim 12, wherein a cross-section of the inner protrusion portion is square.

14. The PDC cutter of claim 12, wherein a cross-section of the inner protrusion portion is oval.

15. The PDC cutter of claim 12, wherein the inner protrusion portion is toroidal.

16. The PDC cutter of claim 12, wherein the inner protrusion portion comprises a convex profile and a central concave profile.

17. A drill bit comprising:

a bit body;

at least one blade formed on the bit body;

at least one PDC cutter disposed on the at least one blade, the at least one PDC cutter comprising:

a body formed from a substrate material;

an ultrahard layer disposed on the body; and a concave cutting face perpendicular to an axis of the body, wherein the concave cutting face slopes downward from an outer circumferential portion towards the axis of the body.

18. The drill bit of claim 17, wherein the concave cutting face further comprises a central domed portion.

19. The drill bit of claim 17, wherein a diameter of the central domed portion is between 20 and 80 percent of a diameter of the PDC cutter.

* * * * *